US009873187B2

(12) United States Patent
Bungter

(10) Patent No.: US 9,873,187 B2
(45) Date of Patent: Jan. 23, 2018

(54) HYDRAULIC PRESSING TOOL AND METHOD FOR CONTROLLING A HYDRAULIC PRESSING TOOL

(75) Inventor: Martin Bungter, Monchengladbach (DE)

(73) Assignee: NOVOPRESS GMBH PRESSEN UND PRESSWERKZEUGE & CO. KG, Neuss (DE)

( * ) Notice: Subject to any disclaimer, the term of this patent is extended or adjusted under 35 U.S.C. 154(b) by 962 days.

(21) Appl. No.: 13/881,121

(22) PCT Filed: Oct. 26, 2011

(86) PCT No.: PCT/EP2011/068725

§ 371 (c)(1),
(2), (4) Date: Apr. 23, 2013

(87) PCT Pub. No.: WO2012/055901

PCT Pub. Date: May 3, 2012

(65) Prior Publication Data

US 2013/0206022 A1 Aug. 15, 2013

(30) Foreign Application Priority Data

Oct. 28, 2010 (DE) ..... 10 2010 049 946

(51) Int. Cl.
*B30B 1/32* (2006.01)
*B21D 7/06* (2006.01)
(Continued)

(52) U.S. Cl.
CPC ..... *B25B 27/10* (2013.01); *B21D 39/04* (2013.01); *B21J 15/20* (2013.01); *B21J 15/26* (2013.01);
(Continued)

(58) Field of Classification Search
CPC .. B30B 1/32; B30B 1/38; B30B 1/323; B30B 1/326; B30B 1/42; B30B 15/166;
(Continued)

(56) References Cited

U.S. PATENT DOCUMENTS 3,326,120 A * 6/1967 Schneider ..... A22C 7/0023 100/232
3,884,262 A * 5/1975 Assembergs ..... B29C 45/82 137/115.25
(Continued)

FOREIGN PATENT DOCUMENTS

DE 202004000215 U1 4/2001
DE 20308966 U1 10/2004
(Continued)

OTHER PUBLICATIONS

International Search Report dated Jan. 13, 2012 for PCT application No. PCT/EP2011/068725.
(Continued)

*Primary Examiner* — Jimmy T Nguyen
(74) *Attorney, Agent, or Firm* — Ohlandt, Greeley, Ruggiero & Perle, LLP

(57) ABSTRACT

A hydraulic pressing tool which is particularly suitable for pressing pipe fittings, and which has a hydraulic pump connected to an electric motor is provided. With the aid of the hydraulic pump, hydraulic fluid is pumped from a tank into a piston chamber to operate the hydraulic piston. The pressure prevailing in the piston chamber is determined by a pressure sensor. When a pressure limit is reached, a solenoid valve is opened by the control device such that the hydraulic fluid flows back out of the piston chamber, through the channels, and into a reservoir.

6 Claims, 1 Drawing Sheet

(51) Int. Cl.

| | |
|---|---|
| ***B25B 27/10*** | (2006.01) |
| ***B25F 5/00*** | (2006.01) |
| ***B25B 27/00*** | (2006.01) |
| ***H01R 43/042*** | (2006.01) |
| ***B21J 15/20*** | (2006.01) |
| ***B30B 1/42*** | (2006.01) |
| ***B21D 39/04*** | (2006.01) |
| ***B21J 15/26*** | (2006.01) |
| ***B30B 15/16*** | (2006.01) |

(52) U.S. Cl.
CPC ..... *B25B 27/00* (2013.01); *B25F 5/005* (2013.01); *B30B 1/326* (2013.01); *B30B 1/42* (2013.01); *B30B 15/166* (2013.01); *H01R 43/0427* (2013.01); *Y10T 29/53226* (2015.01)

(58) Field of Classification Search
CPC . B21J 15/20; B21J 15/26; B25F 5/005; B25B 27/10; B25B 27/146; B25B 27/00; H01R 43/0427; H01R 43/0428; B21D 39/048; B21D 22/02; B21D 42/02; B21D 39/04; B21D 28/00
USPC ..... 100/50, 269.01, 269.14, 269.15, 269.16, 100/269.18, 347; 72/453.01, 453.15, 72/453.16, 453.18, 416, 466.8; 29/525.06, 751
See application file for complete search history.

(56) References Cited

U.S. PATENT DOCUMENTS

| | | | | | |
|---|---|---|---|---|---|
| 4,226,110 | A * | 10/1980 | Suganuma | H01R 43/0427 | 137/454.5 |
| 5,113,679 | A * | 5/1992 | Ferraro | F15B 15/2853 | 72/19.9 |
| 5,195,354 | A * | 3/1993 | Yasui | B25B 27/10 | 29/751 |
| 5,425,164 | A * | 6/1995 | El Dessouky | B21J 15/205 | 29/243.524 |
| 5,553,478 | A | 9/1996 | Di Troia | | |
| 6,065,326 | A * | 5/2000 | Frenken | B21J 15/20 | 29/751 |
| 6,276,186 | B1 * | 8/2001 | Frenken | B21D 39/04 | 29/751 |
| 7,908,963 | B2 * | 3/2011 | Frenken | B25B 27/10 | 100/269.01 |
| 2004/0262333 | A1 * | 12/2004 | Huber | B01D 53/90 | 222/207 |
| 2005/0204732 | A1 * | 9/2005 | Kouzu | F01N 3/22 | 60/307 |

FOREIGN PATENT DOCUMENTS

| | | | |
|---|---|---|---|
| DE | 102008024018 | A1 | 11/2008 |
| DE | 10200802895 | A1 | 12/2009 |
| EP | 0676835 | A2 | 10/1995 |
| EP | 0941812 | A1 | 9/1999 |
| EP | 0941813 | A1 | 9/1999 |
| EP | 1244187 | A1 | 9/2002 |

OTHER PUBLICATIONS

International Preliminary Report on Patentability dated May 21, 2013 for PCT application No. PCT/EP2011/068725.

* cited by examiner

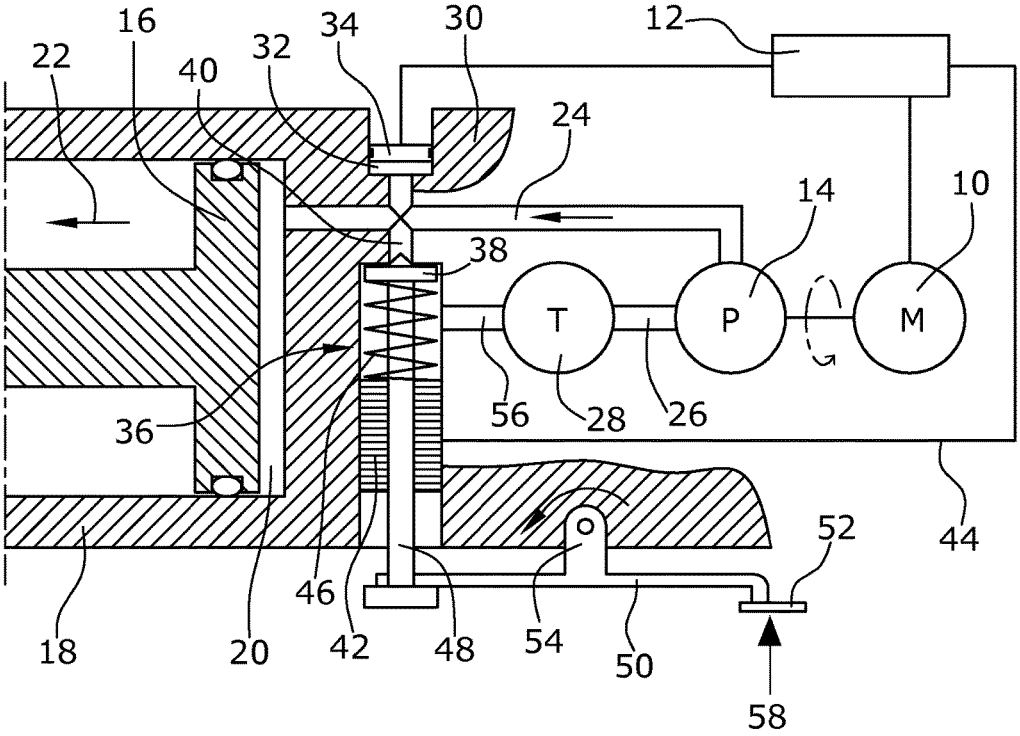
16
22
40
32
34
30
12
24
14
10
38
T
P
M
36
56
28
26
44
52
46
18
20
42
48
54
50
58

HYDRAULIC PRESSING TOOL AND METHOD FOR CONTROLLING A HYDRAULIC PRESSING TOOL

BACKGROUND

1. Field of the Disclosure

The disclosure relates to a hydraulic pressing tool, as well as to a method for controlling a hydraulic pressing tool.

2. Discussion of the Background Art

Hydraulic pressing tools comprise a hydraulic pump driven by an electric motor. In order to generate a pressing force, the hydraulic pump feeds hydraulic fluid from a reservoir into a piston chamber. A hydraulic piston is arranged in the piston chamber, by which piston the pressing force is transmitted to the tool, usually indirectly via a tool fitting. In order to end the pressing operation, it is known to provide a pressure limiting valve in a return path through which the hydraulic fluid can be returned from the piston chamber into the reservoir. These are spring-loaded valves that open when a limit pressure is exceeded. When the limit pressure is reached, and thus the pressing operation is completed, the mechanical pressure limiting valve thus opens automatically. Since the pressure in the piston chamber thereby decreases abruptly, it is possible to detect an increase in the rotation speed of the electric motor, for instance, and to deactivate the electric motor as a consequence.

In addition to providing a pressure limiting valve for the pressing force in the return path, a control valve may possibly be provided. In this case, as described in DE 20 2004 000 215 for a handheld pressing device, the pressure limiting valve is arranged in the hydraulic piston and a control valve is arranged in the housing. The valve is a flow-controlled valve.

Both pressure limiting valves and control valves have the disadvantage of being sensitive to soiling, e.g. by wear debris in the hydraulic oil. Insofar, high demands are made on the precision of these components. This results in high manufacturing costs. Mechanical pressure limiting valves have the further disadvantage that the limit pressure at which the pressure limiting valves opens is difficult to maintain constant over the entire service life. This is due to fatigue of the helical spring present in the pressure limiting valve, as well as to wear. Therefore, it is necessary check pressing tools regularly with respect to the limit pressure at which the pressure limiting valve opens. This is done, for example, by means of separate checking devices with which the maximum force generated by the pressing tool is checked. Since upward deviations in the pressing force result in an overload of the tool and downward deviations in the pressing force may possibly result in defective pressing, extensive regular maintenance of the pressing tool is required. Further, pressure limiting valves are subject to other interference factors over their entire service life, such as varying temperatures, wear and soiling.

It is an object of the disclosure to provide a hydraulic pressing tool, as well as a device for controlling a hydraulic pressing tool, wherein constant pressing forces can be ensured with high reliability over an extended period of time.

SUMMARY

The hydraulic pressing tool of the present disclosure, which is suited in particular to join pipes by means of pipe fittings to be compressed, comprises a hydraulic pump driven by an electric motor. The electric motor is connected with a control device. For the actuation of a tool or a tool fitting, pressure is applied to a hydraulic piston. For this purpose, the hydraulic pump pumps a hydraulic fluid from a reservoir into a piston chamber. After a limit pressure has been reached in the piston chamber, a valve means opens a return path through which the hydraulic fluid can flow from the piston chamber into the reservoir. By opening the valve means in the return path, the hydraulic piston can be moved back to its initial position. This is effected by means of a spring, for example, which urges the hydraulic piston back to its initial position and thereby feeds the hydraulic oil into the reservoir. According to the disclosure, the valve means comprises a pressure sensor and a solenoid valve. With the pressure sensor, the hydraulic pressure prevailing the piston chamber is measured in particular in a constant manner, and the pressure measured is transmitted to the control device or is interrogated from the pressure sensor by the control device. When the predetermined limit pressure is reached, the control device actuates the solenoid valve in order to open the return path. At the same time, the control device can also deactivate the electric motor, or it may suitably drive the existing or another hydraulic pump to draw the fluid from the piston chamber.

Thus, according to the disclosure, no mechanical pressure limiting valve is required. Rather, the determination or the measuring of the limit pressure is effected by means of a pressure sensor. Such pressure sensors are extremely reliable over long periods of time and are subject to only minor variations. Possible wear occurring in the solenoid valve, e.g. at the valve seat and the valve plate, as well as soiling by debris and the like, have no influence on the functionality of the present hydraulic press tool, since the limit pressure is determined by the pressure sensor and is therefore not dependent on the mechanical properties of a pressure limiting valve.

Preferably, the solenoid valve comprises a magnetic coil which is energized to open or close the solenoid valve. In a preferred embodiment, the valve is opened by energizing the solenoid valve. Thus, such a valve is closed in the de-energized state. When reaching the limit pressure, the magnetic coil is driven accordingly by the control device or the control device energizes the magnetic coil directly.

Similarly, it is possible to provide a solenoid valve that is kept closed in particular by energizing the magnetic coil in a pulsed manner. Thus, an opening of the valve is effected by the control device interrupting the current supply to the magnetic coil.

Preferably, the solenoid valve comprises a spring element which may be an elastomeric body or a helical spring, for instance. Depending on the design, the spring element keeps the solenoid valve closed or open in the de-energized state.

In a particularly preferred embodiment, the solenoid valve of the valve device is designed such that it serves as an overload safety device. For this purpose, the solenoid valve, in particular the spring element of the solenoid valve, is designed such that the solenoid valve opens when a maximum pressure is reached or exceeded, regardless of whether the magnetic coil is energized or not. Due to this double function of the solenoid valve, an additional safety valve can be omitted that would otherwise possibly be required to provide a redundant system by which, for example, overload is avoided even if the pressure sensor takes wrong pressure measurements. With a solenoid valve that is closed in the de-energized state, for example, the spring element presses the valve plate against the valve seat in the closed state.

Here, the spring element may be designed such that upon exceeding a predetermined maximum pressure, the spring force is overcome and thus the solenoid valve is opened.

In another preferred embodiment of the disclosure the valve device is additionally connected with an emergency opening device, in particular of mechanical design. Thereby, it is ensured that, for example, when a user's finger gets caught, the pressing pressure acting on the tool is reduced immediately by means of the emergency opening device. The emergency opening device may be in the form of an electric switch, so that when the switch is actuated a corresponding control of the solenoid valve is triggered by energizing or de-energizing the magnetic coil. However, it is particularly preferred to provide a mechanical emergency opening device. This is preferably realized such that an actuator element, such as an actuator rod, is connected with the valve plate. By actuating, i.e. in particular by shifting, the actuator rod, the valve plate is displaced and thus the solenoid valve is opened mechanically. In a preferred development of the disclosure, the solenoid valve can be designed such that it has three functions, namely opening the return path when the limit pressure is reached, the function of an overload safety device, as well as an emergency opening function.

The disclosure further refers to a method for controlling a hydraulic pressing tool, in particular a hydraulic pressing tool of the type described above. According to the method of the present disclosure, the pressure prevailing in the piston chamber is determined by the pressure sensor and is transmitted to the control device or is interrogated from the pressure sensor by the control device. When a limit pressure is reached, the control device causes the solenoid valve to open. This is effected, for example, by the control device simply generating a signal that is processed correspondingly by the solenoid valve, or, depending on the design of the solenoid valve, by the control device directly or indirectly causing the energizing of the magnetic coil or the de-energizing of the magnetic coil. In addition, it is also possible to deactivate the electric motor when the limit pressure is reached. This may also be done when an operator actuates the emergency opening device or when the solenoid valve, functioning as an overload safety device, opens in reaction to reaching the maximum pressure.

Another advantage of the hydraulic pressing tool of the disclosure, as well as of the method for controlling a hydraulic pressing tool is that different pressing forces can be realized in a simple manner. These may be entered via a display, for example. It is likewise possible for the pressing tool to transmit information about the required pressing force to the control device. This may be effected by providing a suitable memory chip in the pressing tool.

The following is a detailed description of the disclosure of a preferred embodiment with reference to the accompanying drawing.

BRIEF DESCRIPTION OF THE DRAWINGS

The FIGURE illustrates, in partial section, a schematic diagram of the portion of a hydraulic pressing tool relevant to the disclosure.

DETAILED DESCRIPTION OF THE PREFERRED EMBODIMENT

The hydraulic pressing tool of the present disclosure comprises an electric motor 10 connected with a control device 12 for its control. The electric motor 10 is used to drive a hydraulic pump 14. Further, the hydraulic pressing tool comprises a hydraulic piston 16 adapted to be displaced within a piston chamber 20 formed by a cylinder 18. A pressing tool or a tool fitting for the pressing tool is connected with the left end of the hydraulic piston 18 that is not illustrated in the FIGURE. By displacing the hydraulic piston 16 in the direction of an arrow 22, the pressing tool is actuated and thereby a press fitting is compressed, for example.

The hydraulic pump 14 is connected with the piston chamber 20 via an infeed 24 and with a reservoir 28 via a line 26. For a displacement of the hydraulic piston 16 in the direction of the arrow 22, the hydraulic pump 14 pumps hydraulic fluid from the reservoir 28 through the lines 24, 26 into the piston chamber 20.

The piston chamber 20 is connected with a pressure chamber 32 via a duct piece 30 such that the same pressure prevails in the pressure chamber 32 as in the piston chamber 20. A pressure sensor 34 is arranged in the pressure chamber 32. The pressure sensor 34 measures, in particular continuously, the pressure prevailing in the pressure chamber 32, and thus the pressure prevailing in the piston chamber 20, and transmits a corresponding signal to the control device 12.

In the embodiment illustrated, a solenoid valve 36 is arranged opposite the pressure sensor 34. A valve plate 38 of the solenoid valve 36 closes an opening of a fluid duct 40 that is also connected with the piston chamber 20. Further, the solenoid valve 36 comprises a magnetic coil 42 connected with the control device 12 via a line 44. Furthermore, the solenoid valve 36 comprises a helical spring 46 which urges the valve plate 38 into the closed position. In the embodiment illustrated, it is possible to open the magnetic valve 36 by energizing the magnetic coil 42. By energizing the magnetic coil 42, the valve plate 38 is moved towards the magnetic coil 42, i.e. downward in the FIGURE.

Moreover, the valve plate 38 is connected with an actuation rod 48. The actuation rod 48 may be actuated via a lever element 50. By pressing on a releasing element 52 of the lever 50, the lever 50 is pivoted about a fulcrum 54 provided at the housing of the pressing tool. Thereby, the actuator rod 48 is pulled outward, or downward in the FIGURE. By moving the valve plate 38 in the direction of the magnetic coil 42, or downward in the FIGURE, the solenoid valve is caused to open against the force of the spring element 46.

Thus, in order to perform a pressing operation, the electric motor 10 is started first and hydraulic fluid is pumped by the hydraulic pump 26 into the piston chamber 20 via the infeed. When a limit pressure detected by the pressure sensor 34 is reached, the control device 12 generates a signal by which the magnetic coil 42 is energized. Simultaneously, the electric motor 10 can be deactivated. Due to the energizing of the magnetic coil 42, the valve plate 38 is attracted and the solenoid valve 36 is opened thereby. Thus, the hydraulic fluid can flow from the piston chamber 20 into a reservoir 28 through the duct 40 as well as through a return path 56. The hydraulic piston 16 is pushed back into its initial position by a spring, not illustrated herein, whereby the hydraulic oil is supplied into the reservoir 28.

In an emergency situation, e.g. when a finger of an operator of the pressing tool gets caught therein, it is possible to press on the releasing element 52 in the direction of an arrow 58 so that the actuator rod 48 is opened downward in the FIGURE and also the valve 36 is opened by moving the valve plate 38. At the same time, the electric motor 10 can be deactivated as a result of the opening of the solenoid valve 36. By opening the solenoid valve 36 using the actuator rod, the hydraulic fluid is pushed back into the reservoir 28 again.

Preferably, the spring element 46 is designed such that upon reaching or exceeding a maximum pressure in the piston chamber 20, which is above the normal limit pressure, the solenoid valve 36 is also opened. The opening is effected mechanically, independent of the energizing of the magnetic coil 42, by pushing the valve plate 38 back against the spring force exerted by the spring element 46. Thereby, a mechanical overload safety device is realized that still prevents overload even in the event of a failure of the pressure sensor 34.

What is claimed is:

1. A hydraulic pressing tool for compressing pipe fittings, comprising an electric motor, a hydraulic pump driven by the electric motor, a control device connected to the electric motor, a hydraulic piston that actuates the pressing tool by supplying hydraulic fluid from a reservoir into a piston chamber by means of the hydraulic pump, a valve comprised of a pressure sensor and a solenoid valve having a spring element and a valve plate, wherein the solenoid valve is disposed in a return path between the piston chamber and the reservoir, wherein the solenoid valve opens the return path in accordance with a pressure signal transmitted from the pressure sensor to the control device when a limit pressure detected by the pressure sensor is reached, wherein the spring element maintains the solenoid valve in a closed position, and wherein the spring element is configured to function as a mechanical overload safety device by opening the solenoid valve when a maximum pressure is exceeded, and an emergency opening device comprised of an actuation element having an actuation rod connected with the valve plate for the mechanical opening of the solenoid valve.

2. The hydraulic pressing tool of claim 1, wherein the solenoid valve further comprises a magnetic coil, wherein the solenoid valve opens when the magnetic coil is energized.

3. The hydraulic pressing tool of claim 2, wherein the solenoid valve acts on the valve plate.

4. A method for controlling a hydraulic pressing tool comprised of an electric motor, a hydraulic pump driven by the electric motor, a control device connected to the electric motor, a hydraulic piston that actuates the pressing tool by supplying hydraulic fluid from a reservoir into a piston chamber by means of the hydraulic pump, a valve comprised of a pressure sensor and a solenoid valve having a valve plate and a spring element, wherein the solenoid valve is disposed in a return path between the piston chamber and the reservoir, and an emergency opening device comprised of an actuation element having an actuation rod connected with the valve plate for the mechanical opening of the solenoid valve, the method comprising:

detecting, by the pressure sensor, the pressure in the piston chamber, transmitting the pressure to the control device, and opening the solenoid valve when a limit pressure or a maximum pressure is reached.

5. The method of claim 4, wherein the control device deactivates the electric motor when the limit pressure is reached, the maximum pressure is reached, or when the emergency opening device is actuated.

6. The method of claim 4, wherein the limit pressure and/or the maximum pressure are adjustable so that different pressing forces can be applied by the pressing tool.

* * * * *